United States Patent [19]

Arnold et al.

[11] Patent Number: 4,577,605

[45] Date of Patent: Mar. 25, 1986

[54] ARRANGEMENT FOR CONTROLLING A FUEL METERING APPARATUS AND HAVING AN EMERGENCY COTROL SYSTEM

[75] Inventors: Herbert Arnold, Eberdingen; Michael Horbelt, Schwieberdingen; Berthold Seibel, Kornwestheim; Hans-Peter Ströbele, Stuttgart; Peter Werner, Wiernsheim, all of Fed. Rep. of Germany

[73] Assignee: Robert Bosch GmbH, Stuttgart, Fed. Rep. of Germany

[21] Appl. No.: 673,869

[22] Filed: Nov. 21, 1984

[30] Foreign Application Priority Data

Nov. 24, 1983 [DE] Fed. Rep. of Germany ..... 3342379

[51] Int. Cl.[4] ..... F02M 51/00

[52] U.S. Cl. ..... 123/479; 364/431.11

[58] Field of Search ..... 123/416, 417, 479; 364/431.11

[56] References Cited

U.S. PATENT DOCUMENTS 3,834,361 9/1974 Keely ..... 123/479

4,255,789 3/1981 Hartford et al. ..... 123/417 X

*Primary Examiner*—Tony M. Argenbright

*Attorney, Agent, or Firm*—Walter Ottesen

[57] ABSTRACT

The invention is directed to an arrangement for controlling a fuel metering apparatus controlled by a microprocessor and supplemented with an emergency control system. In the event of a microprocessor failure due to a defect, the system attempts to restart the microprocessor. At the same time, an emergency operation pulse generator assumes control of the fuel metering apparatus. Such an emergency control system is particularly suited for fuel metering apparatus which serve to control internal combustion engines for motor vehicles.

12 Claims, 2 Drawing Figures

ARRANGEMENT FOR CONTROLLING A FUEL METERING APPARATUS AND HAVING AN EMERGENCY COTROL SYSTEM

FIELD OF THE INVENTION

The invention relates to an arrangement for controlling a fuel metering apparatus of an internal combustion engine which is equipped with a microprocessor and an emergency control system.

BACKGROUND OF THE INVENTION

Microprocessors are generally characterized by high operating reliability. However, this high reliability can no longer be warranted if the microprocessors operate in an environment subjected to heavy electrical interference. This is the case, for example, when microprocessors are used in automotive vehicles. Upon a malfunction or failure of the system controlling the fuel metering apparatus in automotive vehicles, a safe operating condition of the vehicle is no longer ensured. In such an event, an emergency mode of operation of the fuel metering apparatus and thus of the automotive vehicle must be ensured to enable the vehicle to continue driving at least temporarily. A vehicle that stalls on a malfunction of the controlling microprocessor is in almost any case likely to involve high cost for the user and possible subsequent damage. An example for this is the use of the microprocessor in combination with a tractor drive and the occurrence of a malfunction on a difficult terrain. Another example is the failure of a microprocessor controlling the internal combustion engine of a passenger vehicle that is just about to pass another vehicle on a narrow road. In either case, safety reasons demand that the vehicle be able to drive on, at least temporarily, and also to reach the nearest service station, for example.

From U.S. Pat. No. 4,287,565, a monitoring system for program-controlled apparatus is known wherein during each program run at least one check pulse can be obtained and, in the absence of a check pulse, a new program run is released. This known monitoring system detects whether the errors occurring in the program run are caused by temporary disturbances or by system failure, thus providing a criterion for the activation of an emergency control system. A faulty program run or a program that was stopped by a temporary fault is properly resumed by resetting it to program start. The user of the system may then decide whether or not an emergency mode of operation of the program-controlled apparatus is to be activated. In the known system, however, an automatic control of an emergency mode of operation is not provided.

Further, from German published patent application DE-OS No. 31 30 094 (corresponding to U.S. Pat. No. 4,534,328) an emergency control system for a diesel engine is known wherein a signal processing unit and/or the position controller are assigned emergency control arrangements which are switched in automatically or manually. With the emergency control system, the signal indicative of the accelerator pedal position can be transmitted to the signal processing unit directly or indirectly. The prerequisite in this system is, however, that the microcomputer itself is still intact while the one or the other sensor provided for the control of the microcomputer may be defective.

SUMMARY OF THE INVENTION

By contrast, the emergency control system of the invention affords the advantage of permitting an emergency operation of the vehicle even in the event of a complete failure of the microprocessor and/or the sensors controlling the microprocessor. This is accomplished by an independent emergency operation pulse generator which assumes control of metering fuel in the event of a malfunction or failure of the microprocessor. Another advantage of the invention is that the emergency control system of the invention can be implemented with a minimum amount of hardware.

Switching of the driver stage which controls the final stage determining the duration of fuel metering is already accomplished by the reset pulse generator. At the same time, a signal may be issued to the user, indicating the presence of an emergency control condition. It is another advantage that the duration of the emergency control pulse is adjustable even in the emergency mode of operation. Finally, it is an advantage that the emergency operation pulse generator is always active, also during the normal operation of the fuel metering apparatus; this permits the emergency mode of operation to be started without any delay as soon as a malfunction occurs in the microprocessor.

BRIEF DESCRIPTION OF THE DRAWING

The invention will now be described with reference to the drawing wherein.

DESCRIPTION OF THE PREFERRED EMBODIMENTS OF THE INVENTION

Figure 1:
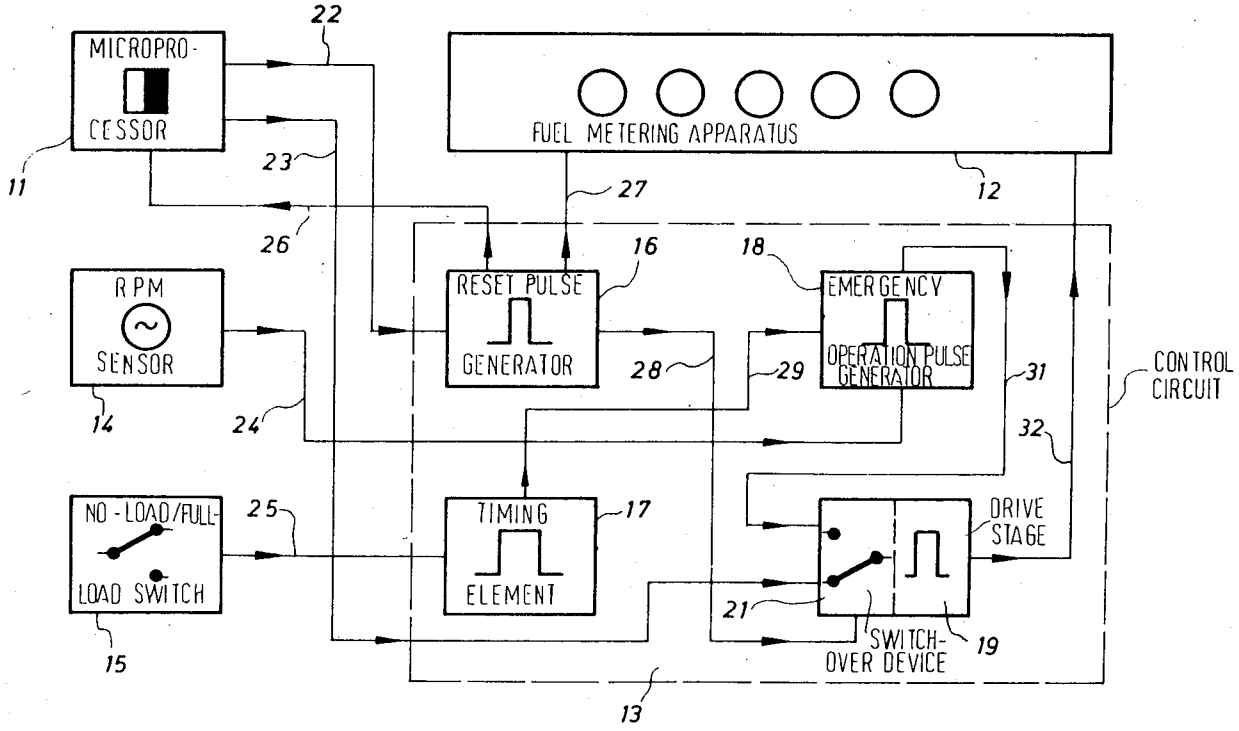
FIG. 1 is a block diagram illustrating the essential components of the arrangement of the invention; and, FIG. 2 is a graphical representation of the pulses occurring in the arrangement of the invention shown in FIG. 1.

In FIG. 1, a microprocessor 11 is provided for the control of a fuel metering apparatus 12. For this purpose, a control circuit 13 is inserted between microprocessor 11 and fuel metering apparatus 12. Further, an engine speed sensor 14 and a switch 15 are connected to inputs of control circuit 13. Switch 15 may be a no-load/full-load switch of fuel metering apparatus 12, for example. Engine speed sensor 14 may be provided in the ignition system; however, a separate tachometer generator may also be used. Control circuit 13 includes a reset pulse generator 16, a timing element 17, an emergency operation pulse generator 18 and a driver stage 19. A switch-over device 21 is integrated into driver stage 19. Timing element 17 may also be realized by an external wiring of control circuit 13, with the time being controllable by a switch.

An output line 22 connects microprocessor 11 to reset pulse generator 16 and another output line 23 connects the microprocessor to switch-over device 21. An output line 24 leads from speed sensor 14 to emergency operation pulse generator 18. Switch 15 is connected to timing element 17 via an output line 25. Reset pulse generator 16 is connected to the following: an input of microprocessor 11 via an output line 26; fuel metering apparatus 12 via an output line 27; and, switch-over device 21 via an output line 28. A line 29 connects timing element 17 to emergency pulse generator 18. The output of emergency pulse generator 18 is connected to switch-over device 21 via a line 31, and the output of driver stage 19 is connected to fuel metering apparatus 12 via a line 32.

Figure 2:
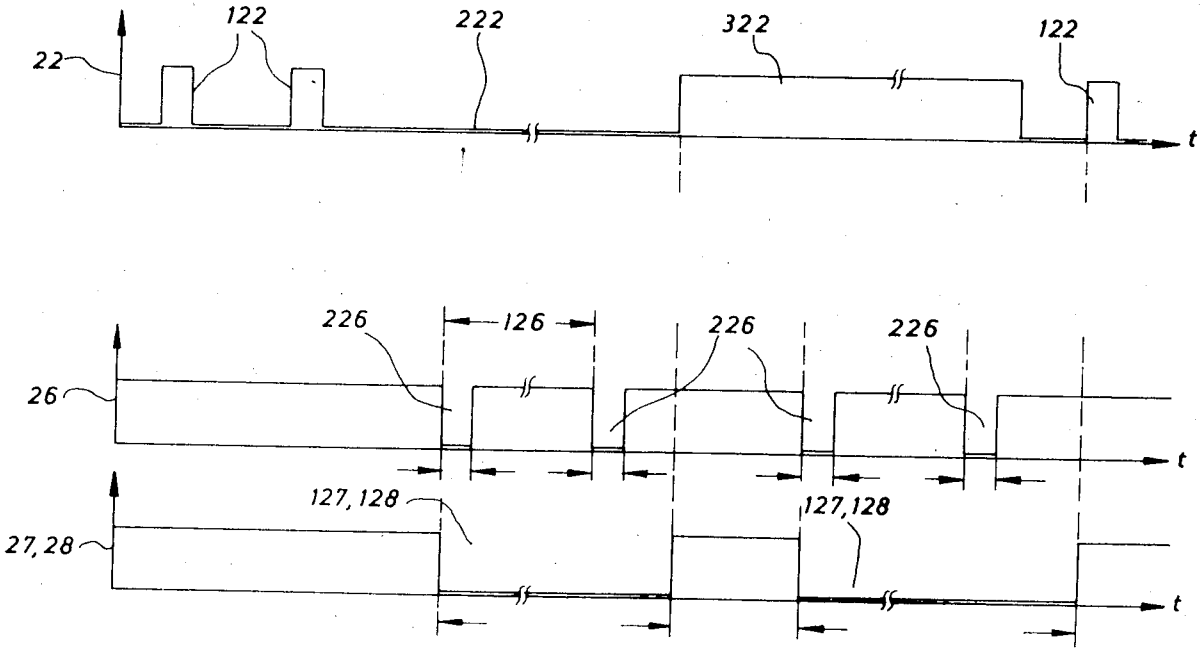

The top diagram of FIG. 2 shows possible output signals of microprocessor 11 which may occur on connecting line 22 as a function of time t. Below this diagram, the pulses which can occur on line 26 are illustrated. Finally, the third diagram shows the pulses that can be transmitted on line 27.

In microprocessor 11, a cyclic program is executed cyclically in a conventional manner which, among other functions, also serves to control fuel metering apparatus 12. While the program is being executed, line 23 transmits pulses which are dependent on the speed of the internal combustion engine; these pulses are transmitted via driver stage 19 to fuel metering apparatus 12. To this end, switch-over device 21 is set to a position in which the pulses can be transferred from line 23 to driver stage 19 and thus onwards via line 32 to fuel metering apparatus 12. With the program running cyclically in the microprocessor, on each program cycle a check pulse 122 will be issued which is also transmitted to reset pulse generator 16 via line 22. As long as pulses 122 arrive at reset pulse generator 16 at the predetermined regular intervals, output 26 of the reset pulse generator remains constantly at a high potential. However, if there are no pulses 122 from microprocessor 11 which is the case, for example, if they fail to appear at point 222 or if a continuous pulse occurs at point 322, then reset pulse generator 16 will issue reset pulses 226 at a predeterminable time interval 126. Reset pulses 226 are transmitted to microprocessor 11 to cause it to restart a program cycle from the beginning. Reset pulses 226 will continue to be issued until microprocessor 11 has resumed its proper operation, issuing check pulses 122 again.

Simultaneously with the issuance of reset pulses 226, output line 27 issues an information 127 indicating the presence of an emergency mode of operation. At the same time, a substantially identical pulse 128 on line 28 will operate switch-over device 21 such that the input of driver stage 19 is connected to the output of emergency operation pulse generator 18.

The emergency operation pulse generator 18 is a generator of the type known as a monostable flip-flop and is actuated by the ignition pulses. The duration of the emergency operation pulses is determined by timing element 17. Timing element 17 acts on the emergency operation pulses such that they are approximately equal to the conventional injection pulses. For example, a no-load/full-load switch can switch control timing element 17 in dependence on the load of the internal combustion engine. The number of emergency operation pulses is determined by engine speed sensor 14 via line 24. Therefore, if an emergency condition exists, fuel metering apparatus 12 receives its control pulses from emergency operation pulse generator 18 via line 31, switch-over device 21, driver stage 19 and line 32. While the frequency of the emergency operation pulses is proportional to the speed of the internal combustion engine, their duration depends on the load condition of the internal combustion engine. Control is transferred to the emergency mode of operation already in the absence of one single check pulse from the microprocessor.

It is understood that the foregoing description is that of the preferred embodiments of the invention and that various changes and modifications may be made thereto without departing from the spirit and scope of the invention as defined in the appended claims.

What is claimed is:

1. An arrangement for controlling a fuel metering apparatus of an internal combustion engine such as for a motor vehicle, the arrangement comprising:

a microprocessor for generating control pulses corresponding to a program for controlling said fuel metering apparatus, said microprocessor including monitor means for transmitting check pulses indicative of a normal operation of said microprocessor;

a driver stage having an input connected to said microprocessor for receiving said control pulses and having an output for transmitting said control pulses on to said fuel metering apparatus;

a reset pulse generator for receiving said control pulses and for supplying, in the absence of said control pulses, a restart pulse to said microprocessor to restart said program;

an emergency control system for controlling the operation of said fuel metering apparatus in the event of a malfunction of said microprocessor, the emergency control system including: circuit means for recognizing the absence of said control pulses and for generating a switching pulse in response to said absence; an emergency operation pulse generator for generating pulses to control said fuel metering apparatus; and, switching means actuable in response to said switching pulse for separating said input of said driver stage from said microprocessor and connecting the same to the output of said emergency operation pulse generator;

timing means for generating pulses for determining the duration of said pulses generated by said emergency operation pulse generator; and, a no-load switch/full-load switch operatively connected to said timing means;

said timing means including means for adjusting the duration of said pulses generated thereby in dependence upon the position of said no-load/full-load switch.

2. The arrangement of claim 1, said input of said driver stage being switched to said output of said emergency operation pulse generator when the absence of only a single one of said control pulses is recognized by said circuit means.

3. The arrangement of claim 2, said circuit means being part of said reset pulse generator, said switching pulse being an output of said reset pulse generator.

4. The arrangement of claim 1, said emergency control system further comprising timing means for determining the duration of said pulses generated by said emergency operation pulse generator.

5. The arrangement of claim 1, said timing means being a component of said emergency control system.

6. The arrangement of claim 1, said emergency control system further comprising rpm sensor means for controlling the sequence of said pulses generated by said emergency operation pulse generator.

7. The arrangement of claim 6, said rpm sensor means being an independent rpm sensor for said internal combustion engine.

8. The arrangement of claim 1, said emergency operation pulse generator being continuously switched on during the operation of said fuel metering apparatus.

9. The arrangement of claim 1, said switching means being a part of said driver stage.

10. The arrangement of claim 3, said switching pulse being transmitted also to said fuel metering apparatus thereby providing an indication of the existence of an emergency situation.

11. The arrangement of claim 1, comprising an ignition pulse generator for controlling the sequence of the pulses generated by said emergency operation pulse generator.

12. The arrangement of claim 1, said emergency control system further comprising visual indicating means for indicating the presence of an emergency situation.

* * * * *

UNITED STATES PATENT AND TRADEMARK OFFICE

CERTIFICATE OF CORRECTION

PATENT NO. : 4,577,605

DATED : March 25, 1986

INVENTOR(S) : Herbert Arnold et al

It is certified that error appears in the above-identified patent and that said Letters Patent is hereby corrected as shown below:

In the title of the patent, on the third line thereof: delete "COTROL" and substitute -- CONTROL -- therefor.

In column 1, line 4: delete "COTROL" and substitute -- CONTROL -- therefor.

Signed and Sealed this

*Twenty-ninth* Day of *July 1986*

[SEAL]

*Attest:*

DONALD J. QUIGG

*Attesting Officer*

*Commissioner of Patents and Trademarks*